United States Patent [19]

Vrignaud

[11] Patent Number: 4,704,890

[45] Date of Patent: Nov. 10, 1987

[54] PRESS TOOL PROVIDED WITH A SYSTEM FOR GUIDING AND RELIEVING A METAL STRIP

[75] Inventor: Dorice Vrignaud, La Roche Sur Yon, France

[73] Assignee: Esswein, S.A., La Roche Sur Yon, France

[21] Appl. No.: 849,632

[22] Filed: Apr. 9, 1986

[30] Foreign Application Priority Data

Apr. 16, 1985 [FR] France ..... 85 05714

[51] Int. Cl.[4] ..... B21D 43/00

[52] U.S. Cl. ..... 72/428; 72/361; 83/449

[58] Field of Search ..... 72/344, 349, 361, 405, 72/428; 83/444, 448–450; 226/196, 198, 199

[56] References Cited

U.S. PATENT DOCUMENTS

| | | | |
|---|---|---|---|
| 1,768,294 | 6/1930 | Reid | 72/345 |
| 2,260,891 | 10/1981 | Ekstedt et al. | 72/405 |
| 2,297,948 | 10/1942 | Eisenhauer | 72/405 |
| 2,979,004 | 4/1961 | Kenville et al. | 72/345 |
| 3,003,447 | 10/1961 | Gavazzi | 72/361 |
| 3,072,309 | 1/1963 | Hill | 83/449 |
| 3,213,657 | 10/1965 | Robb | 72/361 |
| 3,368,383 | 2/1968 | Marszal | 72/361 |
| 4,033,168 | 7/1977 | Fisk | 72/344 |
| 4,282,736 | 8/1981 | Mashburn | 72/427 |
| 4,326,402 | 4/1982 | Wallis | 72/344 |

FOREIGN PATENT DOCUMENTS

| | | |
|---|---|---|
| 2413451 | 10/1974 | Fed. Rep. of Germany . |
| 2711696 | 9/1978 | Fed. Rep. of Germany . |
| 3108688 | 9/1982 | Fed. Rep. of Germany . |
| 2379332 | 2/1977 | France . |

*Primary Examiner*—Lowell A. Larson

*Attorney, Agent, or Firm*—Pollock, VandeSande & Priddy

[57] ABSTRACT

A press tool is provided with a system for guiding and relieving a metal strip which is caused to pass through the tool. During the successive manufacture of several pieces having different predetermined dimensions and forms. The system for guiding and relieving a metal strip, which is provided with adjustable sliding and interchangeable elements for controlling the position of the metal strip within the press tool, is adapted to be adjusted to be used for certain preselected widths of metal strips and for different degrees of brittleness of the metal strips used, as well as for different pieces to be manufactured having a predetermined bulk of the upper parts and for various mechanical operations performed by the tool.

9 Claims, 11 Drawing Figures

PRESS TOOL PROVIDED WITH A SYSTEM FOR GUIDING AND RELIEVING A METAL STRIP

BACKGROUND OF THE INVENTION

1. Field of the invention

The present invention concerns a press tool fitted with a system for guiding and relieving or disengaging a metal strip.

For the manufacture of thin metal or sheet metal pieces tools that are mounted upon a press or stamping machine are utilized to carry out punching, swaging, cambering, bending and similar operations. These tools are often so-called "picking-up tools" and "following-up tools". The term "picking-up tool" normally designates a press tool that operates only once on a metal sheet so as to confer thereupon a more or less complex form. Operations such as punching, swaging, bending, stamping, etc., generally cannot be performed by a single picking-up tool but require a range of such tools. The term "following-up tool" generally designates a tool comprising a plurality of aligned working stations, disposed one after the other, upon which a metal or sheet metal strip is caused to pass stepwise, at a determined rate, in order to carry out on this strip at each of these working stations, a preestablished operation such as punching, swaging, bending, stamping, etc. A finished piece is obtained at the exit from the last one of said working stations which is severed from said metal or sheet metal strip and presenting a more or less complex form.

These tools generally comprise stamps and dies, attachment parts such as blank-holders, punch-holders and die-holders, stay blocks and systems for guiding the metal or sheet metal strips in their step-by-step progression between the stamps and the dies.

According to a conventional technique, each stamping tool is designed so as to correspond to a given piece to be manufactured. This means that there exist as many tools as there are types of pieces to be manufactured. In fact, when using such tools, any modification of dimension and/or shape of a given work piece requires a complete change of the tool. This results in considerable expense in raw material, man-power and time.

According to another known technique, the dies and stamps of a following-up tool are detachable and interchangeable so that various pieces having different dimensions and shapes can be successively produced upon conveniently changing the dies and stamps. However, such a tool can be used only for a single width of metal strip and produces only pieces comprised within narrow dimensional limits of the width as well as the height of the piece. When pieces having relatively small dimensions are produced with such a tool from a single metal strip designed for pieces having relatively greater dimensions, this creates waste in the form of the resulting large amount of metal scrap. When such a tool is designed for manufacturing relatively flat pieces, it is not adapted to produce pieces subjected to bending which results in relatively bulky dimensions in height, since the metal is not sufficiently raised above the dies. The risk is also present that the piece will be blocked in its progression or become severely deformed.

It is an object of the present invention to overcome these drawbacks by providing an efficient, economic press tool fitted with an improved system for guiding and relieving or raising (i.e. disengaging) the metal strip, which allows the tool to be utilized with metal strips having different widths for successively manufacturing various pieces having different dimensions, as well as pieces having different heights, while achieving considerable savings in raw material, man-power and production time.

With this and other objects in view, the invention provides a press tool provided with a system for guiding and relieving a metal strip moving through the tool between dies and punches, which comprises a system for guiding and relieving the metal strip, which system includes sliding and interchangeable adjustable means, which are adapted to be adjusted and used for different preselected widths of metal strips and for varying degrees of brittleness of the metal strips used, as well as for different predetermined bulks of the upper parts of the pieces to be manufactured and for the various mechanical operations carried out by the tool.

BRIEF DESCRIPTION OF THE DRAWINGS

The present invention will become more apparent from the following description of various embodiments, given by way of non-limitative illustration and referring to the appended drawings in which.

Figure 1:
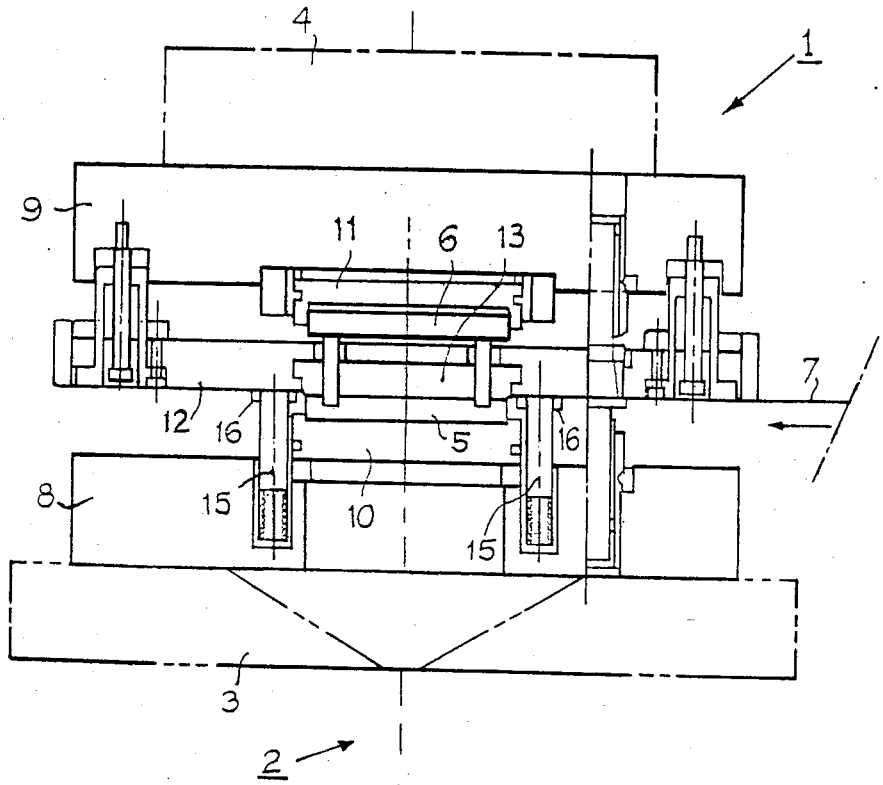
FIG. 1 represents an incomplete schematic vertical cross-sectional view of a press tool according to the invention provided with interchangeable stamps and dies.

It should be noted that the present invention applies to a picking-up tool as well as to a following-up tool.

A press tool 1, according to an embodiment of the invention, as schematically illustrated in FIGS. 1, 6, 7, 8, is intended to be mounted upon a press or a stamping machine 1, the table 3 and the slide or plunger 4 of which are schematically represented in broken lines.

Press tool 1 comprises a die 5 and a detachable stamp 6 performing respectively various mechanical operations such as punching, swaging, stamping, etc., on a metal or sheet metal strip 7 fed at a predetermined rate, and producing a finished piece presenting a more or less complex shape.

Removable die 5 and stamp 6 are secured respectively to a lower stay block 8 and an upper stay block 9 by die-holders 10 and stamp-holder 11.

Metal or sheet metal strip 7 is firmly applied against die 5 during execution of the mechanical operations carried out by punch or stamp 6 and die 5, by a blank-holder 12, the detachable part 13 of which also acts as a guide by sliding for stamp 6, and as means for relieving the metal or sheet metal strip 7 seized by this stamp 6.

According to one important feature, the system 14 for guiding and relieving the metal or sheet metal strip 7 during its travel through tool 1 comprises adjustable sliding means 15 and interchangeable means 16 (FIG. 2) rendering this system adjustable during the relieving of metal strip 7 in the area of die 5, i.e. as a function of the height of the piece to be manufactured and adaptable to certain preselected widths and to certain degrees of brittleness of the metal strips used, as well as to various mechanical operations carried out by the tool which may possibly cause a jamming of these metal strips in the area of die 5. The guiding and relieving system 14 is mounted on lower stay block 8 of tool 1.

Correct adjustment of the height of relief or disengagement of metal or sheet metal strip 7 with respect to die 5 allows this strip to be displaced normally during the operation of tool 1 without being hindered by the presence of both the work piece that is being formed in this strip and the die matrix 5 itself. A correct adaptation of system 14 regarding the means for relieving or raising and guiding the metal or sheet metal strip 7 with respect to dies 5 allows any accidental retention of this strip through its being jammed by said dies 5 to be prevented, which would result in inadmissible deformations of metal strip 7 and possibly in blocking the displacements of this strip or of tool 1; thus any ruptures of metal strip 7 due to its great brittleness are also prevented.

According to another feature, the system for guiding and relieving the metal strip 7 comprises a plurality of vertically movable supports 15, having an adjustable stroke determining their high and low positions implanted in the lower stay block 8 of the tool, uniformly disposed along the path of the metal strip 7, outside the active zones of the matrix 5 and of the stamp 6, diametrically opposed in pairs on the two longitudinal sides of said strip, and constantly elastically biased toward their high position, said system further comprising a range of selective guides which are interchangeable and detachable and adapted to be mounted on the upper ends of said supports so as to act as means for guiding and relieving said metal or sheet metal strip 7 during its travel towards the tool 1, whereby said system 14 is adaptable to preselected widths of the metal or sheet metal strip 7 as well as to the dimensions and the shapes of the pieces to be manufactured, i.e. to their bulk volume.

In an embodiment illustrated in FIGS. 2 to 5, each of the supports 15 of the guiding and relieving or raising system 14 comprises a fixed vertical sheath 17 implanted in lower stay block 8 of tool 1, a movable stud 18, the lower part of which slides vertically in the bore of fixed sheath 17 and the upper part of which carries on its free end a guide 16 acting as means for guiding and relieving or raising metal or sheet metal strip 7. A spring system 20 is mounted between the bottom of the fixed sheath 17 and the lower part of the stud 18, tending to push this stud 18 axially and elastically towards the outside of sheath 17.

Figure 2:
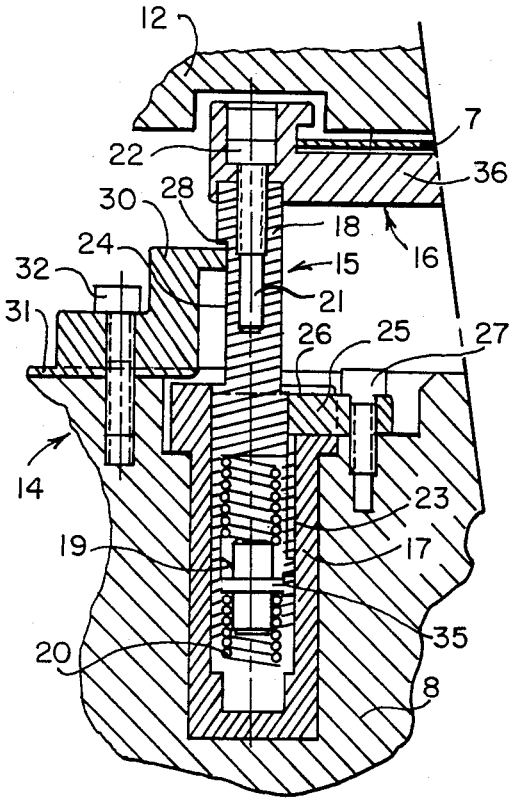
FIG. 2 represents on a different scale a vertical cross-section of a portion of a single side of a controllable and adaptable system for guiding and relieving the metal of sheet metal strip, forming part of the tool shown in FIG. 1, showing the system in the low position.
Figure 6:
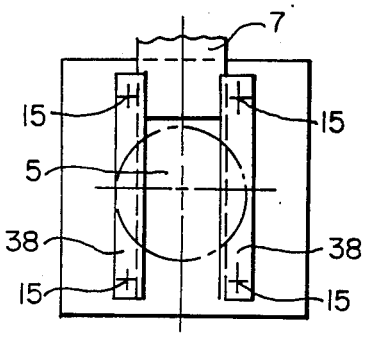
FIG. 6 represents on a different scale a schematic view from above of the lower stay block of the tool shown in FIG. 1, fitted with an interchangeable die and a portion of the system for guiding and relieving the metal strip as illustrated in FIG. 5, provided simply with longitudinal rails.

In the example of FIG. 2, the movable stud 18 comprises in its lower part a blind hole 19 adapted to house a part of spring system 20 and in the end of its upper part a threaded hole 21 adapted to receive an attachment screw 22 of a guide 16; the threaded hole 21 and the attachment screw 22 may also be replaced by a shouldered hole and a ball rod of a known type (not shown). Movable stud 18 furthermore comprises in its surface two grooves or longitudinal flattened parts 23 and 24, one 23 cooperating with a lug or abutment 25 blocked by a radial notch 26 formed in the wall of sheath 17 and fixed by screw 27 to the lower stay block 8 of tool 1 in order to prevent any rotation of the movable stud 18 about its axis during its sliding, while allowing its radial displacement and the other 24, forming at its ends an upper shoulder 28 and a lower shoulder 29 that cooperates with a protruding adjustment wedge or abutment 30 the upper and lower surfaces of which delimit its thickness in order to determine with the shoulder the high position of the movable stud 18, i.e. the displacement stroke of the support 15, otherwise known as the relieving or raising stroke for the metal or sheet metal strip 7 performed by the guiding and relieving or raising system 14. The adjustment wedge or abutment 30 is constituted by one end of an S-shaped piece fixed in a channel 31 of the lower stay block 8 of the tool 1 by a screw 32. The spring system 20 is preferably constituted, as shown in FIGS. 2 to 5, by two compression springs 33, 34 with a cylindrical piece 35 axially intercalated between them. A range of interchangeable and detachable guides 16 of the guiding and relieving or raising system 14 comprises: firstly, interchangeable transversal rails 36 (FIGS. 2, 3 and 8) having several guiding interchannel dimensions 37, each corresponding to a predetermined width of metal or sheet metal strip 7 to be used in tool 1; secondly, interchangeable longitudinal rails 38 having a longitudinal guiding channel 39 (FIG. 5) and several widths defining respectively, in their mounting in pairs and facing each other (FIGS. 6 and 8), several guiding inter-channel dimensions, each corresponding to a predetermined width of metal or sheet metal strip 7 to be used in the tool 1; thirdly, interchangeable spools or rollers 40 grooved for guiding 41 (FIG. 4) having several diameters defining respectively in their mounting in pairs and facing each other (FIG. 7), several guiding interchannel dimensions, each corresponding to a predetermined width of metal or sheet metal strip 7 to be used in the tool 1.

Figure 7:
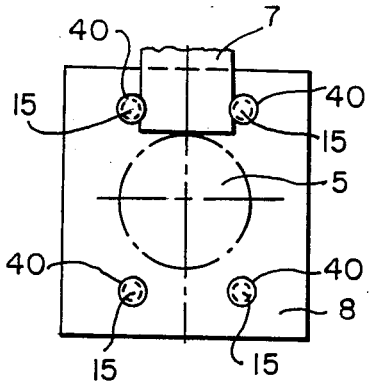
FIG. 7 represents a schematic view from above of the lower stay block of the tool shown in FIG. 1 equipped with an interchangeable die and a portion of the system for guiding and relieving the metal sheet as illustrated in FIG. 4, equipped simply with spools or grooved rollers.
Figure 8:
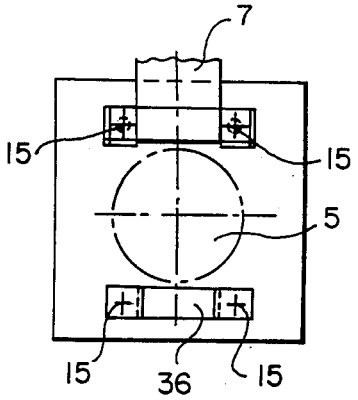
FIG. 8 represents a schematic view from above of the lower stay block of the tool of FIG. 1, equipped with an interchangeable die and the system for guiding and relieving the metal strip as illustrated in FIGS. 2 and 5, equipped with transversal rails.
Figure 3:
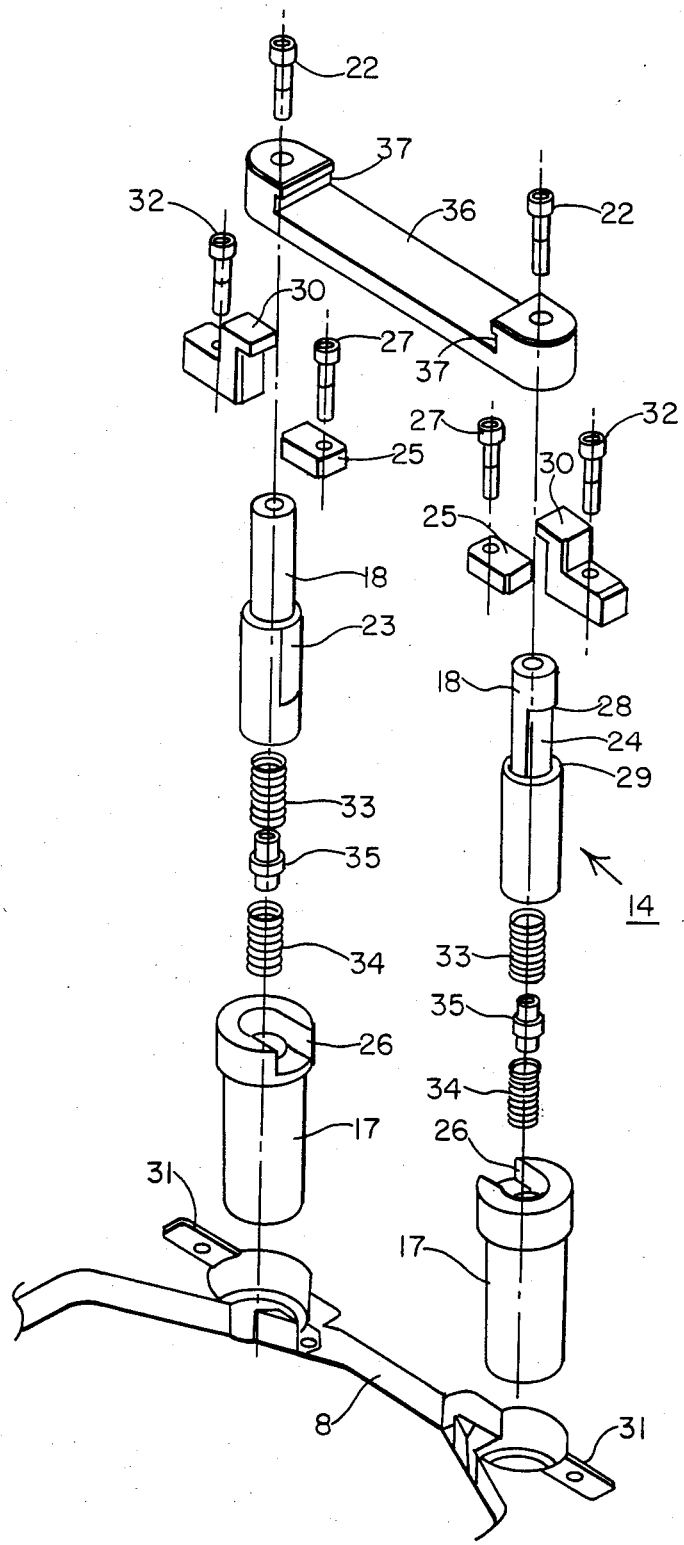
FIG. 3 represents on another scale an exploded view of the portion of the controllable and adjustable system for guiding and relieving the metal or sheet metal strip according to FIG. 2, showing the two sides of that part of this system which is fitted with a transverse rail for guiding and relieving the metal strip.
Figure 4:
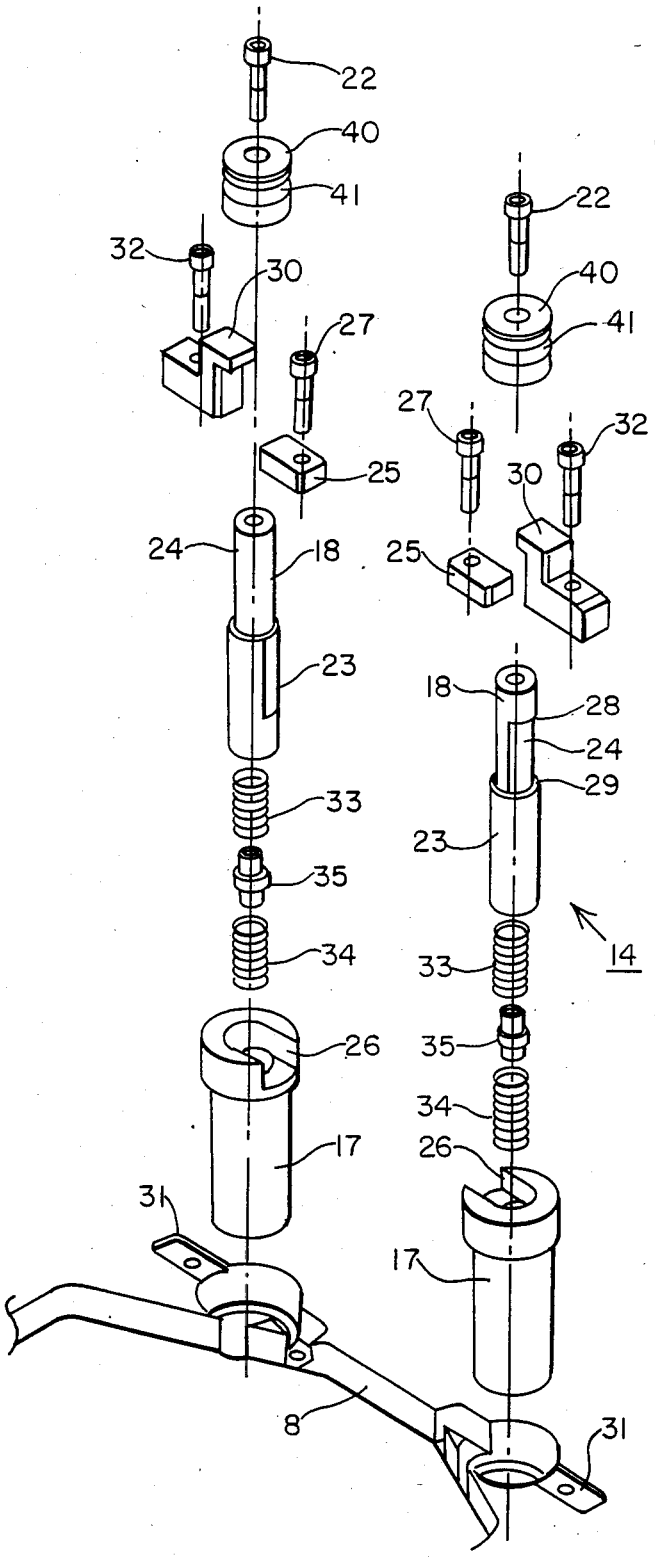
FIG. 4 represents the portion of the system illustrated in FIG. 2, in an exploded view similar to that of FIG. 3, showing this system provided with spools or grooved rollers instead of the transverse rail.
Figure 5:
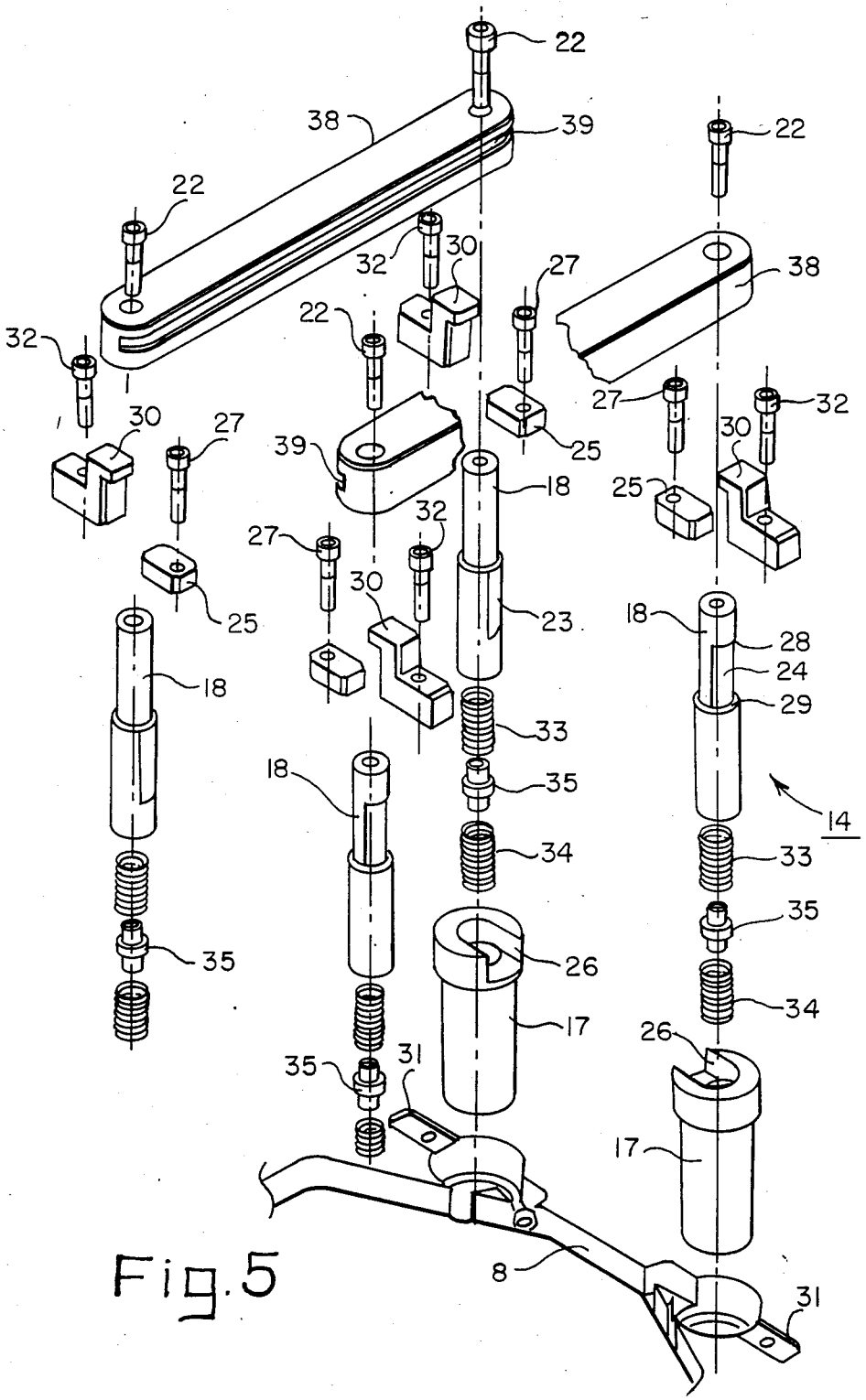
FIG. 5 represents an exploded view of the portion of the system represented in FIG. 2, analogous to that shown in FIG. 3, showing this system fitted with two longitudinal rails instead of a transversal rail.

In the guiding and relieving or raising system 14 mounted on the tool 1, the interchangeable and detachable guides 16 are selected among these transversal rails 36, longitudinal rails 38 and grooved rollers 40. This choice which can be decisive in the correct functioning of tool 1 is often a function of the data or working conditions of tool 1 such as those relating to the brittleness of the metal strip 7, the configuration of the piece to be manufactured and the various mechanical operations to be performed by the tool 1. For example, when the metal or sheet metal strip 7 utilized is neither wide nor brittle and the pieces to be manufactured are flat or cambered pieces, the spools or grooved rollers 40 are preferably mounted on supports 15 of the guiding and relieving or raising system 14 such as illustrated in FIG. 7. When the metal or sheet metal strip 7 is wide or the pieces to be formed in this strip can be seized with respect to the dies 5 due to their form or the mechanical operation to be performed such as a deep swaging, transversal rails 36 are preferably chosen. In fact, in the tool 1, at each withdrawal of the stamps 6 from the blank-holder 12, the transversal rails 36 biased by the movable studs 18 under the action of the springs 33, 34 pass from their low position to their high position, raise the metal strip 7 (FIG. 2) along its whole length, unstick it, i.e. relieve or raise it efficiently from the die 5 and do not deform it. When the metal or sheet metal strip 7 is not wide but is brittle, the longitudinal rails 38 alone (FIG. 6) or the longitudinal rail 38 and the transversal rail 36 together (FIG. 8) are selected so as to prevent any rupture of the metal strip 7. In the tool 1, the system 14 for guiding and relieving the metal or sheet metal strip 7 can be provided simply with transversal rails 36 or also with longitudinal rails 38 and 38 or any other combination of these guides (not represented). A change of guide 16 in the guiding and relieving or raising system 14 is easily accomplished by unscrewing the attachment screws 22 or ball rods. The former guide is replaced by another guide of a different type, on the upper ends of the movable studs 18 and the attachment screws 22 are fastened. This means that the tool 1 of the guiding and relieving system 14 is also easily adaptable to the width of the metal or sheet metal strip 7, to the dimensions of the pieces to be manufactured, or to their bulkiness, and to the mechanical operations to be performed in this metal or sheet metal strip 7 which may possibly provoke its blocking in the die 5. The adjustment wedge or abutment 30 cooperates with the shoulder 29 of the hollow or flattened longitudinal part 24 (FIG. 2) so as to determine the displacement travel or stroke of the movable studs 18 moving from their low position to their high position. Die 5 is generally at the low position level of the movable studs 18. The thinner the wedge or abutment 30, the greater the travel of raising or relieving of the metal or sheet metal strip 7. When a piece to be manufactured is flat, a small raising stroke or travel of the metal or sheet metal strip 7 defined by a relatively thick wedge or abutment is sufficient. When a piece to be manufactured is bulky, a great raising stroke of the metal or sheet metal strip 7 is necessary and a thin wedge or abutment 30 is used. In tool 1, during the downward stroke of the slide 4 of the press 2, the blank-holder 12 pushes downward the metal or sheet metal strip 7 and the movable studs 18, by compressing the springs 33, 34 and the upper shoulder 28 formed in these movable studs by the longitudinal hollow 24 abuts against the upper surface of their wedge or abutment 30 and defines the low position of these studs 18 whereas during an upward stroke of the slide 4, the bank-holder 12 follows said slide, releases the metal or sheet metal strip 7 and the movable studs 18 which, under the thrust of the springs 33, 34, are displaced upward until the lower shoulder 29 formed in these studs 18 by their hollows or longitudinal flattened parts 24 abut against the lower surface of their wedge or abutment 30 and define the high position of these movable studs 18. The adjustment of the vertical raising stroke of the metal or sheet metal strip 7 is associated with the stroke of the slide 4 of the press 2 and with the characteristics of the strip 7 in order to meet two imperative conditions, that of a sufficient raising in order that the parts of the strip 7 downwardly cambered pass above the dies and the elements of the lower part of the tool 1, and that of a limited raising operation so that the parts of the strip 7 upwardly cambered do not hook onto the bank-holder 12, which thereby allows the prevention of any risk of hooking the strip 7 in the tool 1 and of deforming and even blocking this strip 7. The wedge or abutment 30 has, in the example illustrated in FIG. 2, an S-shaped form, the upper end of which cooperates with the shoulder 29 of the hollow or flattened part 24 and the lower part receives the screw 32 that fixes the wedge or abutment 30 to the lower block of tool 1. An adjustment of the raising or disengaging travel of the metal or sheet metal strip 7 becomes apparent by a change of the wedge or abutment 30 through unscrewing and screwing down screw 32. This means that this adjustment of the guiding and relieving system 14 is easy and rapid.

Figure 9:
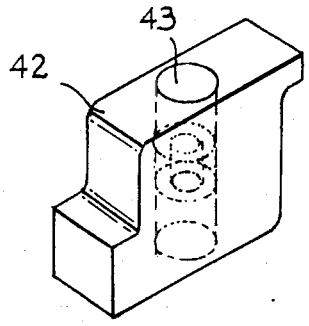
FIGS. 9, 10 and 11 represent on a different scale perspective views of three variants of wedges or abutments having various thicknesses for adjusting the high position determining the stroke of the system for guiding and relieving or raising the metal strip as illustrated particularly in FIG. 2.
Figure 10:
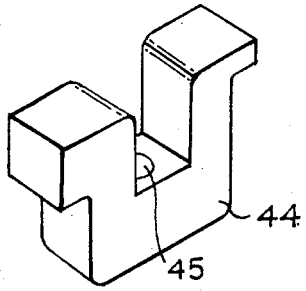
Figure 11:
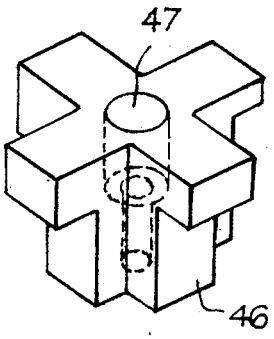

In order to further facilitate such an adjustment, non-limiting embodiments of the wedges or abutments 30 are represented in FIGS. 9 to 11. In a first variant represented in FIG. 9, a wedge or abutment has the shape of an S, the two lateral protruding ends of which acting as adjustment wedges have differently selected thicknesses and the body presenting a central hole 43 for the passage of attachment screw 32.

In a second variant represented in FIG. 10, a V-shaped wedge or abutment 44, the laterally protruding ends of which act as adjustment wedges, have differently selected thicknesses and the body presenting a central hole 45 for the passage of attachment screw 32.

In a third variation represented in FIG. 11, a star-shaped multi-wedge or multi-abutment 46 has laterally protruding ends which act as adjustment wedges of different thicknesses. The body includes a central hole 47 for the passage of attachment screw 32.

I claim:

1. A press tool provided with a system for guiding and relieving a metal strip moving through the tool between dies and punches said system comprising:

(a) a lower stay block mounted on the table of said press tool, said stay block having a plurality of vertically-oriented bores disposed on each side of the path at said metal strip;

(b) vertically movable sliding support means mounted in said bores;

(c) adjustable stop means for limiting the stroke of said support means, said stop means being detachably mounted on the upper surface of said stay block and having stroke-limiting surfaces to limit both the upward movement and the downward movement of said support means, said stop means further being adapted to be positioned on said stay block in at least two different orientations to provide at least two different, predetermined and fixed stop positions;

(d) guide and relieving means for guiding and relieving said metal strip detachably mounted on the upper portion of said sliding support means.

2. A tool according to claim 1 wherein the guiding and relieving means comprises interchangeable and detachable guides in the form of transversal rails having guiding intra-channels, longitudinal rails with guiding longitudinal channels, spools and grooved rollers.

3. A tool according to claim 2 wherein in the guiding and relieving means, the transversal rails comprise several guiding intra-channel dimensions each corresponding to a predetermined metal strip width used in the tool.

4. A tool according to claim 2, wherein in the guiding and relieving means the longitudinal rails comprise several widths defining respectively in their mounting in pairs and facing each other, several guiding inter-channel dimensions each corresponding to a predetermined metal strip width used in the tool.

5. A tool according to claim 2, wherein in the guiding and relieving means the spools or grooved rollers comprise several diameters defining respectively in their mounting in pairs and facing each other, several guiding inter-channel dimensions each corresponding to a predetermined metal strip width used in the tool.

6. A tool according to claim 1 wherein the adjustable stop means of the guiding and relieving system comprises an S-shaped wedge or abutment having laterally protruding ends of which one of the laterally protruding ends ensures the function of the wedge or the abutment.

7. A tool according to claim 6, wherein in the adjustable stop means of the guiding and relieving system the S-shaped wedge or abutment comprises two ends ensuring the function of adjustment wedge or of abutment provided with different predetermined thicknesses.

8. A tool according to claim 1, wherein the adjustable stop means of the guiding and relieving system comprises a V-shaped wedge or abutment having two laterally protruding ends with different predetermined thicknesses.

9. A tool according to claim 1, wherein the adjustable stop means of the guiding and relieving system comprises a star-shaped multi-wedge or multi-abutment which has laterally protruding ends which have different predetermined thicknesses.

* * * * *